United States Patent [19]

Reid, Jr. et al.

[11] 4,193,601

[45] Mar. 18, 1980

[54] SEPARATE COMPONENT CONSTRUCTION WOOD TYPE GOLF CLUB

[75] Inventors: Walter L. Reid, Jr.; Ralph L. Delano, both Mattapoisett; John W. Jepson, Marion, all of Mass.

[73] Assignee: Acushnet Company, New Bedford, Mass.

[21] Appl. No.: 887,883

[22] Filed: Mar. 20, 1978

[51] Int. Cl.[2] ..... A63B 53/04

[52] U.S. Cl. ..... 273/167 R

[58] Field of Search ..... 273/77 R, 167 R, 167 J, 273/169, 173, 174

[56] References Cited

U.S. PATENT DOCUMENTS

| | | | |
|---|---|---|---|
| 713,845 | 11/1902 | Braid et al. | 273/167 K X |
| 1,638,916 | 8/1927 | Butchart | 273/173 X |
| 2,880,002 | 3/1959 | Wetty | 273/169 |
| 3,134,596 | 5/1964 | Boznos | 273/173 |
| 3,985,363 | 10/1976 | Jepson et al. | 273/173 |

FOREIGN PATENT DOCUMENTS

| | | | |
|---|---|---|---|
| 1912 | 5/1931 | Australia | 273/167 K |
| 9873 | of 1896 | United Kingdom | 273/173 |
| 1473891 | 5/1977 | United Kingdom | 273/173 |

*Primary Examiner*—Richard J. Apley

*Attorney, Agent, or Firm*—Eyre, Mann, Lucas & Just

[57] ABSTRACT

A "wood-type" golf club comprising a plurality of separately constructed and finished components is disclosed. In its preferred form, the golf club comprises a face plate, a club head block and a reinforcing collar. The face plate, the club head block and the collar are separately constructed and finished and subsequently assembled into a finished golf club. According to the invention, the construction and finishing of the individual components and subsequent assembly thereof is such that at selected interfaces between the components of different material, relative movement of the components due to thermal expansion, moisture, etc. does not produce visible component interface separation lines. This may be accomplished by providing unequal peripheral dimensions of the components of different materials at the selected interfaces.

7 Claims, 2 Drawing Figures

SEPARATE COMPONENT CONSTRUCTION WOOD TYPE GOLF CLUB

The present invention relates to a "wood type" golf club having separately constructed and finished components.

"Wood type" golf clubs are used where it is desired to hit the ball a long distance and are to be distinguished from "iron type" golf clubs. The difference between "wood type" and "iron type" golf clubs is well known to those in the art and is recognized, for example, in Rule 2 of The Rules of Golf as promulgated by The United States Golf Association and The Royal and Ancient Golf Club of St. Andrews, Scotland. Recent innovations in wood type golf clubs have resulted in the use of a number of different components. See for example U.S. Pat. No. 3,985,363. Heretofore, even when different materials have been used, the practice has been to assemble the golf club head and thereafter final finish the golf club head as an integral assembly. Use of the term "final finishing" herein encompasses all the individual steps which may be required to produce a golf club head ready for market and may include the following: coating, painting, sanding, blending, etc. By ready for market it is meant that no further finishing of the club head is required as opposed to no further work with it, e.g., affixation of a shaft, placing a protective bag aroung it, etc. In order to give the golf club head a sleek and aesthetically pleasing appearance, the peripheral dimensions of the different materials at selected interfaces thereof were previously made equal. This gave the club head a smooth contour and was usually achieved during finishing by hand sanding. These known golf club heads have a serious aesthetic flaw which becomes visible during service of the golf club. For reasons which are not completely understood, no matter how carefully the final finishing is carried out separation of the individual components along component interface lines occurs. It is believed to be due primarily to variations in the moisture content of wood as compared to metal or plastic but may also involve different degrees of thermal expansion, varying degrees of resiliency, or the like. Whatever the cause, such separation substantially mars the club head appearance in that the component interface separation lines are readily visible, even in the most expensive clubs. Accordingly, the prior expensive finishing processes fail to completely accomplish one of their most important objectives, a sleek and aesthetically pleasing club under varying service conditions.

The present invention substantially reduces the foregoing problem with respect to the club appearance and further discloses substantial economic benefits in the production of wood type clubs.

The present invention is further embodied in and carried out by a method for producing a wood type golf club comprising a plurality of components, at least two of which are of different materials and means provided at selected interfaces of the components of different materials for permitting relative, visually non-separating movement thereof, the method comprising separately constructing the components, separately finishing the components prior to assembly thereof into the golf club head, and assembling the finished components into a finished golf club head without assembly finishing thereof. In accordance with the present invention, the means for permitting the relative motion may comprise providing unequal peripheral dimensions of the components of different materials at the selected interfaces.

By permitting visually non-separating movement of the components of different materials with respect to each other, the club head will retain its factory sleek lines during service thereof without the introduction of the interface separation lines. Where unequal peripheral dimensions are used, providing smooth arcuate contours at the interfaces will retain the original sleek overall club head appearance.

These and other aspects of the present invention will be more apparent from the following description and figures of the drawing which illustrate the invention by way of example and in which like numerals refer to like parts.

Figure 1:
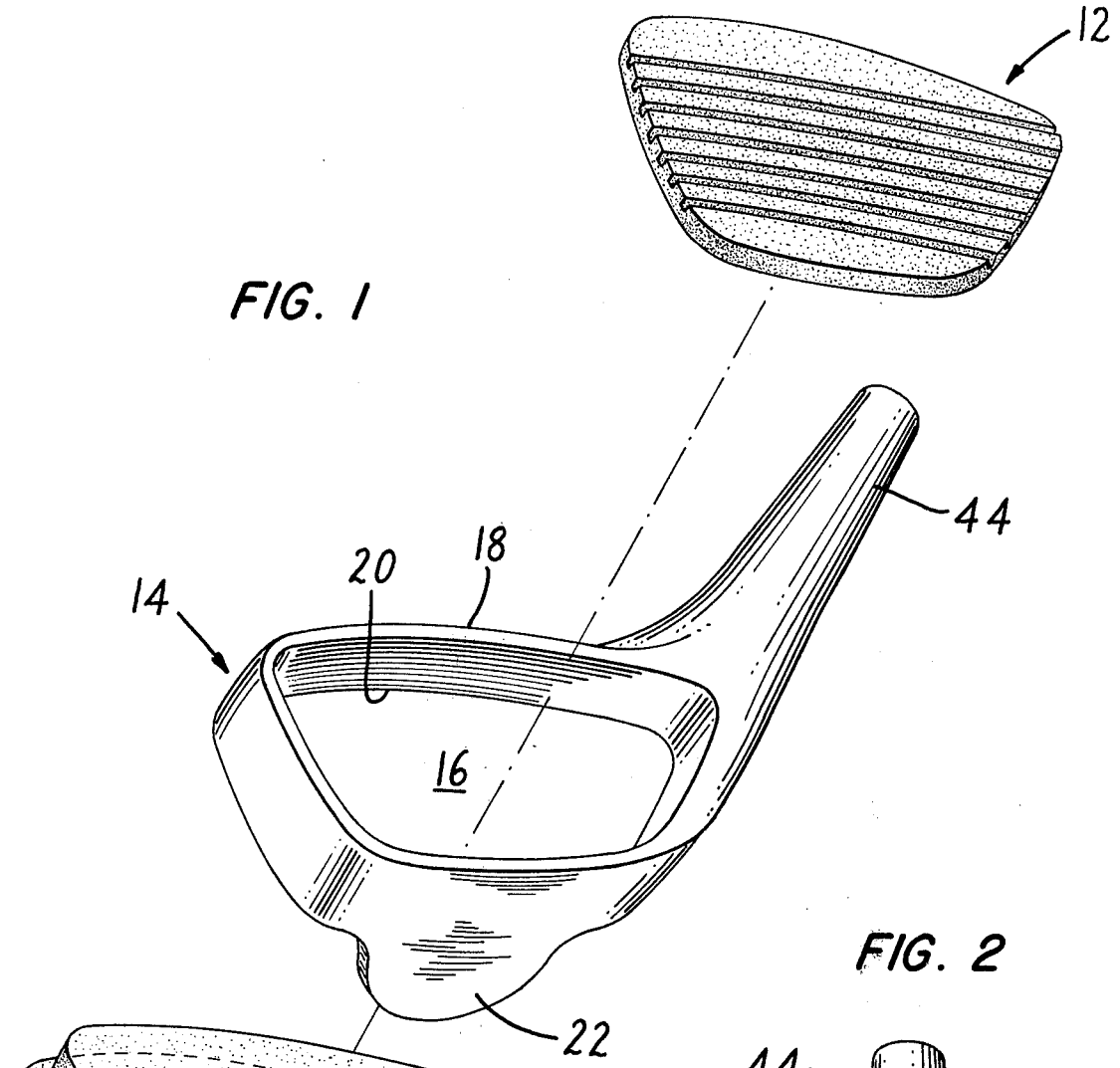
FIG. 1 is an exploded view of a wood type golf club head according to the present invention.

In the U.S. Pat. No. 3,985,363, assigned to the assignee of the instant invention and which is hereby incorporated by reference, an improved wood type golf club is disclosed which comprises a club head block, a face plate, and a reinforcing collar. FIG. 1 generally illustrates the type of golf club disclosed in the aforementioned application. The present invention will be illustrated using a golf club of the type disclosed in the aforementioned patent, i.e., a golf club of the type having a club head block, a face plate and a reinforcing collar. It is to be understood that selection of such a golf club is made for purposes of illustration and it is not intended that such illustration limit the scope and spirit of the present invention.

Referring now to FIG. 1, the components of a wood type golf club head are shown in an exploded view. As there shown, the club head comprises a club head block 10, a face plate 12, and a reinforcing collar 14 having a hole 16 therethrough, front and rear faces 18 and 20, respectively, and a collar sole plate 22. Advantageously, the face plate is of plastic, the collar of aluminum, and the club head block of wood. As described in the aforementioned patent, the club is assembled such that the face plate is integral with the collar front face and the collar rear face is affixed to the club head block, the individual component parts 10, 12, 14 being in intimate contact with each other substantially throughout the area of hole 16. According to known practice, however, in order to give the club head a "good" appearance, the individual components were first assembled into a club head and then finished as an assembly with particular attention being directed to insure equal peripheral dimensions of the components at the selected interfaces thereof. This was usually accomplished through hand sanding, and with particular respect to the aforementioned application a smooth surface contour resulted at the interface of the club head block and the collar, and at the interface of the sole plate and the club head block. As mentioned hereinbefore, however, because the component parts were of different materials, e.g., wood, aluminum and plastic, there was a tendency for the materials to separate during service due to the different expansion and contraction properties of the different materials in accordance with temperature and moisture absorption. Such separation produced the aforementioned visibly detracting component interface lines. Furthermore problems were also encountered with masking of the various pieces in finishing them since some components require different finishes from others or no surface finish at all.

Figure 2:
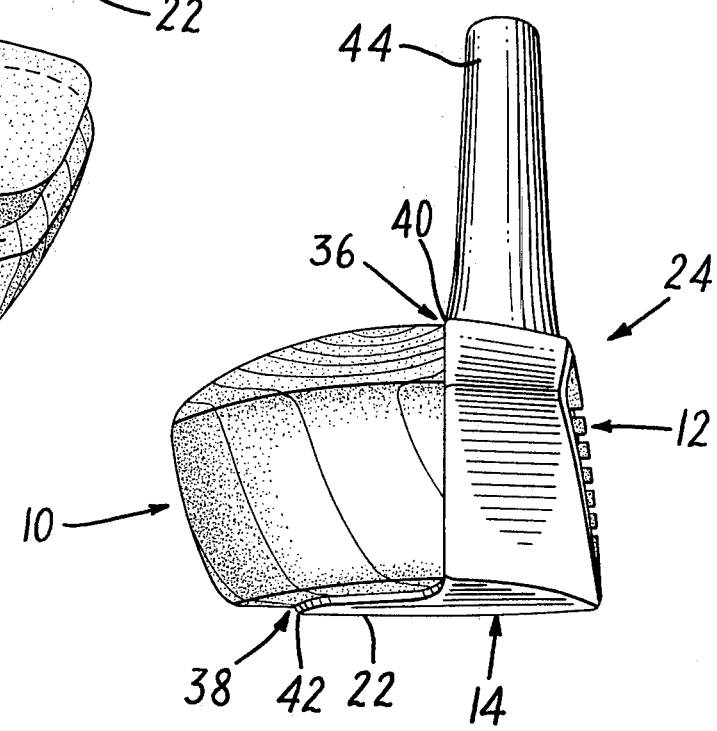
FIG. 2 is an end view of the finished, assembled golf club of FIG. 1 in perspective.

In accordance with the present invention, the component parts of a wood type golf club head are separately constructed and individually finished prior to assembly thereof into a golf club. Referring to FIGS. 1 and 2, the separately finished plastic face plate 12, wood club head block 10 and aluminum collar 14 (FIG. 1) are separately final finished and then assembled into a finished club head 24 and joined generally as described in the aforementioned application with particular respect to the collar-club head block interface 36 and the sole plate-club head block interface 38. In accordance with one aspect of the present invention, the peripheral dimensions of the collar 14, sole plate 22 and club head block 10 at the interfaces 36, 38 may be unequal, e.g., the peripheral surface of the club head block may be offset and indented or recessed from the peripheral surfaces of the collar and collar sole plate at interfaces 36, 38. Preferably, the collar edge 40 and sole plate edge 42 are of arcuate contour of small radius.

Further in accordance with the present invention, collar neck 44 may be formed integral with collar 14 and thereby constructed as a unit. This eliminates the need for finishing the neck separate from the collar.

Golf clubs made according to the present invention possess several important advantages over heretofore known clubs. The present invention essentially eliminates the formation of component interface lines and the failure of the club finish thereat caused by separation of the individual components during service since the club head block and collar during expansion and contraction may, according to the present invention, move relative to each other at the interfaces thereof without the formation of the highly visible component interface lines.

Further advantages are realizable in accordance with the present invention in relation to reduced manufacturing cost and product uniformity. In particular, the collar, which is preferably of aluminum, can be mass-produced by a casting process, giving precise uniformity of shaft to club head and sole plate alignment, as well as providing a precise mounting surface for the club face. Also, the club face, preferably of plastic, can be molded to precise bulge and roll controus and the scoring lines can be molded in. Use of casting and molding eliminates the need for highly skilled clubmakers to fabricate the club. The most complex and critical manufacturing operations, forming of the face contours, cutting the face grooves, and blending of the club neck to the body, are eliminated. With respect to assembling and finishing the clubhead, previously the wood and aluminum were bonded together and then the interface thereof was sanded to a smooth surface as described hereinbefore. In accordance with the present invention, however, they can be finished separately, i.e. the wood club head block, the plastic face plate and the aluminum reinforcing collar may each be separately finished and then these separately constructed and finished components may be bonded in a final assembly operation. This allows selection of an optimum finish for each of the components and eliminates tedious manual blending (e.g. sanding) of the assembly. For example, sanding, staining and lacquering may be preferred for the wood while the aluminum can be plated, chemically treated, buffed, or otherwise treated in a manner that is preferred for metal articles but is not necessarily suitable for wood or plastic. Similarly, the plastic insert can be simply treated as for example with a clear coat of polyurethane as opposed to the usual necessary steps of sanding, blending, coating and the like when the insert is finished as a part of the entire club head block assembly and must thus be subjected to the same finishing steps as the wood club head block. In fact, with the process of the present invention it is possible to mold the club head insert and then use it without any additional finishing thereof. In this instance it is the molding of the club head insert which constitutes the "final finishing".

In addition to the foregoing advantages, there are also other advantages to the process of the present invention. For example, there can be a substantial reduction of in-process inventory. The reason for this is that each of the components is finished separately and thus the manufacturing operation can be carried out in parallel for the separate components rather than sequentially. Thus, no single component is exposed to all of the manufacturing operations. This advantage may be more fully appreciated when it is understood that in conventional formation of "wood type" golf club heads, the wood club head block goes through over 100 operations which takes a period of many weeks. In contrast to this, the wood portion of the club head block of the present invention can be shaped and finished in about ten operations which can be completed in several days. Furthermore, while these operations are being completed on the wood club head block, the reinforcing collar and the face plate can be subjected to finishing operations at the same time in parallel manufacturing processes. As previously discussed, the separate components are not brought together and assembled into a finished structure until each of the components has been individually final finished.

Still another advantage to the process of the present invention is that rework can be substantially reduced or even eliminated. With conventional "wood type" club head blocks, the club head block must be sent back through many manufacturing operations from the point at which a defect occurs or is discovered. In contrast to this, any defect which occurs or is discovered during finishing of the separate components in accordance with the present invention only requires that that individual component be sent back for rework. In fact, the separate components are inexpensive enough at the present time so that it is practical to scrap bad parts just before final assembly and thus have no rework at all. With unitary wood club head blocks, this is not a practical approach from an economic standpoint and, wherever possible, the club head block is sent back for rework.

While the foregoing detailed description has been made with respect to a golf club head comprising a face plate, a club head block, and a reinforcing collar, it is to be understood that the present invention may be practiced on a golf club head comprising other dissimilar material component parts without departing from the spirit and scope of this invention.

The advantages of the present invention, as well as certain changes and modifications of the disclosed embodiment thereof, will be readily apparent to those skilled in the art. It is the applicants intention to cover by their claims all those changes and modifications which could be made to the embodiment of the invention herein chosen for the purposes of the disclosure without departing from the sprit and scope of the invention.

What is claimed is:

1. A method for producing a wood type golf club head comprising a plurality of individual components which mate together, at least one of said individual components being of metal, and at least another of said individual components being of wood having at least one surface coating thereon, said method comprising:

(a) separately forming the individual components;

(b) separately final finishing each component prior to assembly thereof into the golf club head, said final finishing including the application of at least one said surface coating on the wood component; and (c) assembling the final finished individual components into a final finished golf club head.

2. A method for producing a wood type golf club head comprising a plurality of individual components which mate together, at least one of said individual components being a metal reinforcing collar, and at least another of said individual components being a wood club head block having at least one surface coating thereon, said method comprising:

(a) separately forming the individual components;

(b) separately final finishing each component prior to assembly thereof into the golf club head, said final finishing including the application of at least one said surface coating on the said wood club head block; and (c) assembling the final finished individual components into a final finished golf club head.

3. A method for producing a wood type golf club head comprising a plurality of individual components which mate together, at least one of said individual components being a metal reinforcing collar, and at least another of said individual components being a wood club head block having at least one surface coating thereon, and the peripheral dimension of the collar where it will interface with the club head block being greater than the peripheral dimension of the club head block at the said interface, said method comprising:

(a) separately forming the individual components;

(b) separately final finishing each component prior to assembly thereof into the golf club head, said final finishing including the application of at least one said surface coating on the said wood club head block; and (c) assembling the final finished individual components into a final finished golf club head.

4. A final finished wood type golf club head comprising a plurality of individual components which mate together, at least one of said individual components being a metal reinforcing collar, and at least another of said individual components being a wood club head block having at least one surface coating thereon, and each of said individual components having been final finished prior to assembly thereof into the final finished golf club head.

5. The club head of claim 4, wherein the reinforcing collar includes a neck portion.

6. The club head of claim 4, wherein the reinforcing collar includes an integrally formed sole plate.

7. The club head of claim 4, wherein the peripheral dimension of the collar at the interface with the club head is greater than the peripheral dimension of the club head at the said interface.

* * * * *